US005903250A

United States Patent [19]

Lee et al.

[11] Patent Number: 5,903,250

[45] Date of Patent: May 11, 1999

[54] SAMPLE AND HOLD CIRCUIT FOR DRIVERS OF AN ACTIVE MATRIX DISPLAY

[75] Inventors: Sywe N. Lee, Hsinchu, Taiwan; David A. Wayne, Phoenix, Ariz.; Huann-Min Tang; Fang-Chien Kuo, both of Hsinchu, Taiwan

[73] Assignee: Prime View International Co., Hsinchiu, Taiwan

[21] Appl. No.: 08/731,644

[22] Filed: Oct. 17, 1996

[51] Int. Cl.[6] ..... G09G 3/36

[52] U.S. Cl. ..... 345/100; 345/99; 345/103; 345/204

[58] Field of Search ..... 345/87, 88, 92, 345/98, 100, 103, 204, 205, 99; 349/41, 42, 49, 50, 108, 109

[56] References Cited

U.S. PATENT DOCUMENTS

| | | | |
|---|---|---|---|
| Re. 33,882 | 4/1992 | Morogumi | 345/88 |
| 4,825,203 | 4/1989 | Takeda et al. | 345/88 |
| 4,908,609 | 3/1990 | Stroomer | 345/88 |
| 5,412,397 | 5/1995 | Kanatani et al. | 345/99 |
| 5,657,040 | 8/1997 | Kanbara | 345/98 |

*Primary Examiner*—Lun-Yi Lao

*Attorney, Agent, or Firm*—H. C. Lin Patent Agent

[57] ABSTRACT

The number of external column driver chip can be reduced to one in an active matrix liquid crystal display with column input multiplexing driving scheme. At least two sample and hold circuits are used for each column with alternate sampling and holding periods. Video signals are sampled and held at least twice during one line scanning time. These sample and hold circuits are all integrated in the driver chip.

17 Claims, 9 Drawing Sheets

SAMPLE AND HOLD CIRCUIT FOR DRIVERS OF AN ACTIVE MATRIX DISPLAY

BACKGROUND OF THE INVENTION

This invention relates to active matrix display driving circuits—in particular to a novel sample and hold (S/H) circuit incorporated into a column driver circuit which can be used for sampling and holding signals at least once in a horizontal line time for an active matrix display device.

Active matrix display devices commonly utilize a plurality of display elements which are arranged in a matrix of columns and rows on a transparent substrate. The most commonly used display device is the liquid crystal display (LCD) or similar devices realized on a transparent substrate, normally a glass.

A display system that incorporates an active matrix liquid crystal device (AMLCD)) also includes column (data) drivers, controllers and row drivers. A conventional AMLCD requires one external lead for each column or row line. For example, a video display with a resolution of 480×240 would require 115,200 external connecting leads. The need for this large number of leads in the display is a serious problem, which gets worse as the resolution and complexity of displays increase.

One solution to the problem is to design a self-scanned AMLCD with different driving schemes which can reduce not only the number of column input leads but also the external column driver integrated circuit (IC) chips (or complexity of column driver circuit) as compared to the conventional unscanned AMLCD. In such a driving scheme, the input column data signals, such as video signals, are grouped into N groups, each with M columns, and arranged in a multiplexed fashion to feed the display sequentially through column line input leads using a designated portion of a line time, approximately 1/N of a line sampling time, Ts, for each group. For those with ordinary skill in the art, one horizontal line time Trow is about 63.5 $\mu$S for NTSC video signals with effective line sampling time, Ts, is about 50 $\mu$S.

For a display with a resolution of 480×240, for example, M and N can be equal to 120 and 4, respectively, or other combinations such that M×N=480. In this way, the number of input data column leads is only 1/Nth of the total number of display column lines and only one external column driver chip is used if the driver chip has M outputs. Although it is common to use the least number of external column driver chips which is usually one, the number of external column driver chips can be more than one, depending on the number of outputs for each column driver chip. For example, if the number of outputs for each column driver chip is M/2, the requirement is two chips.

In a conventional unscanned AMLCD display system, there should be N column driver chips used if each column driver chip has M outputs. Two S/H circuits are needed for each of M output stages in the column driver chip. During any given line sampling time period, Ts, one of two S/H circuits samples the input video signal for the next horizontal line, while the other S/H circuit holds the data for outputting to the current scanning horizontal line. Therefore, there are only one sampling and one holding operations during a horizontal line time if the S/H circuit driving scheme in accordance with prior art.

As stated previously, the number of external column driver chips can be reduced to one in an AMLCD with the column input multiplexing driving scheme. However, in this single column driver chip display system, the approach of using two S/H circuits, with the driving scheme in accordance with the prior art for each output stage of a column driver chip, would not work if N is greater than one, because one of the two S/H circuits samples the input video signal of the next horizontal line only once and the other S/H circuit holds the signal for outputting to the current horizontal line only once during one horizontal scanning line. Thus, there is no time for N time divisions during one line time. Therefore, a column driver circuit with conventional S/H circuit driving scheme would not be able to be incorporated into a display system with column input multiplexing driving scheme.

SUMMARY OF THE INVENTION

An object of the present invention to sample and hold at least once in a horizontal line time for an active matrix display device.

Another object of this invention is to incorporate the novel S/H circuit driving scheme into a display system where the column inputs are coupled to the display device in a multiplexed fashion.

Still another object of the present invention is to reduce the number of input leads and column driver chips in a display system.

A further object of the present invention is to increase the manufacturing yield and to reduce the manufacturing costs of a display device.

These objects are achieved in this invention by processing more than one sample and hold operation during each line time. The video signal is fed from a driver to a multiplexer which drives M number of columns. The driver circuit includes a number of sample and hold circuits. Each sample and hold circuit has two or more branches, each comprising a sampling switch, a storage capacitor, and a holding switch. The timings for turning on the sampling switch and the holding switch of each branch are not overlapping and happen more than once during one line scanning time. By multiplexing, the number of column drivers can be minimized as low as one.

DETAILED DESCRIPTION OF THE PREFERRED EMBODIMENT

Figure 1:
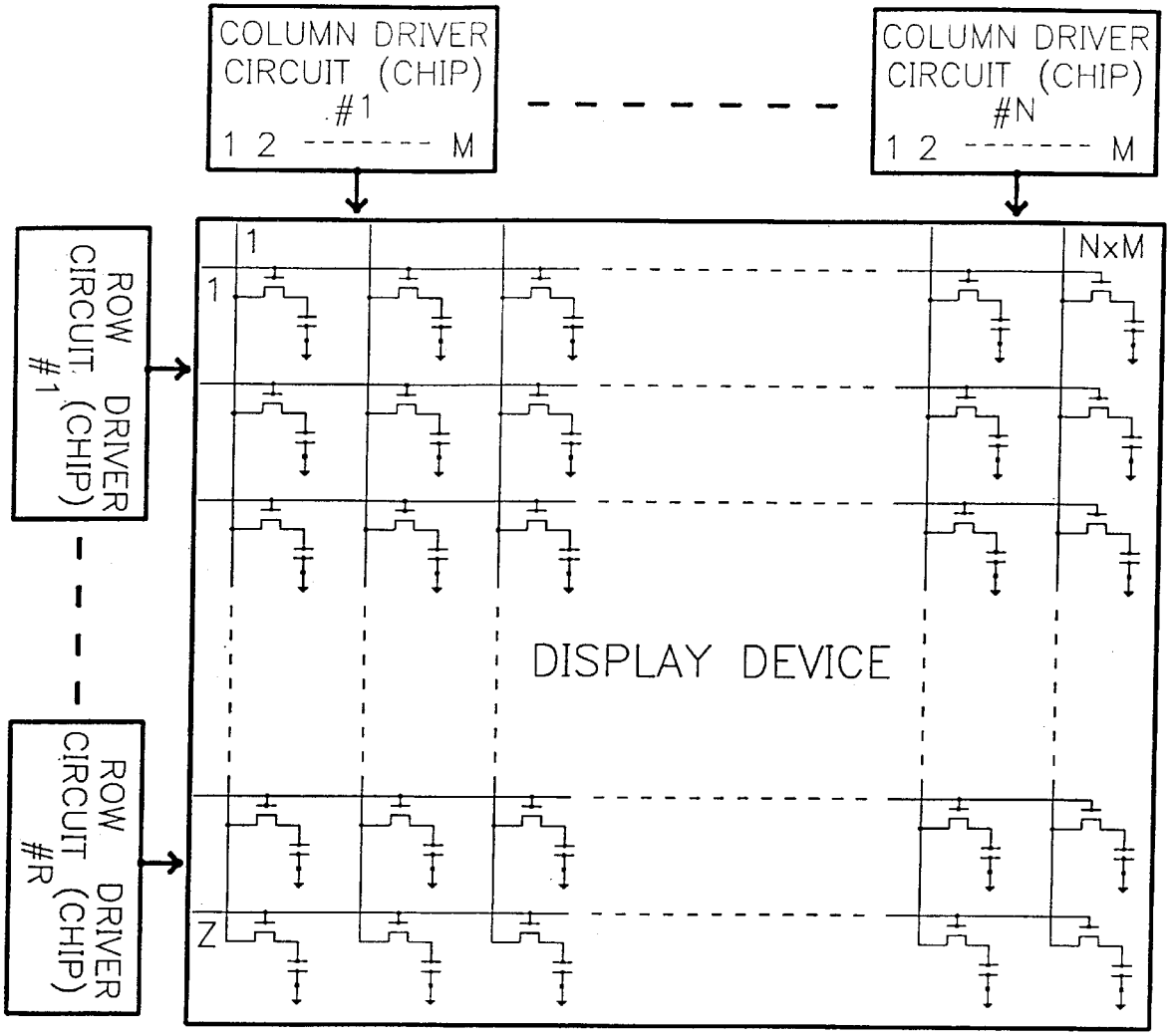
FIG. 1 (PRIOR ART)
FIG. 1 is block diagram of a display system in accordance with the prior art.

This invention will be described with the use of a 480×240 pixel array color TV as an example. FIG. 1 shows a basic block diagram of a commonly used display system, which includes a display device with N normally identical column driver circuits and R normally identical row select driver circuits external to the display device. Both the column and the row select driver circuits can be implemented with chips or partially integrated into the display device. The total number of column lines and thus column input leads on the display is N×M, where N is 4 and M is 120 in this example. The row select driver may be of any type known in the art and sequentially activates the pixels in each selected row, and rows 1 through Z are driven sequentially, where Z is 240 in this example.

Figure 2:
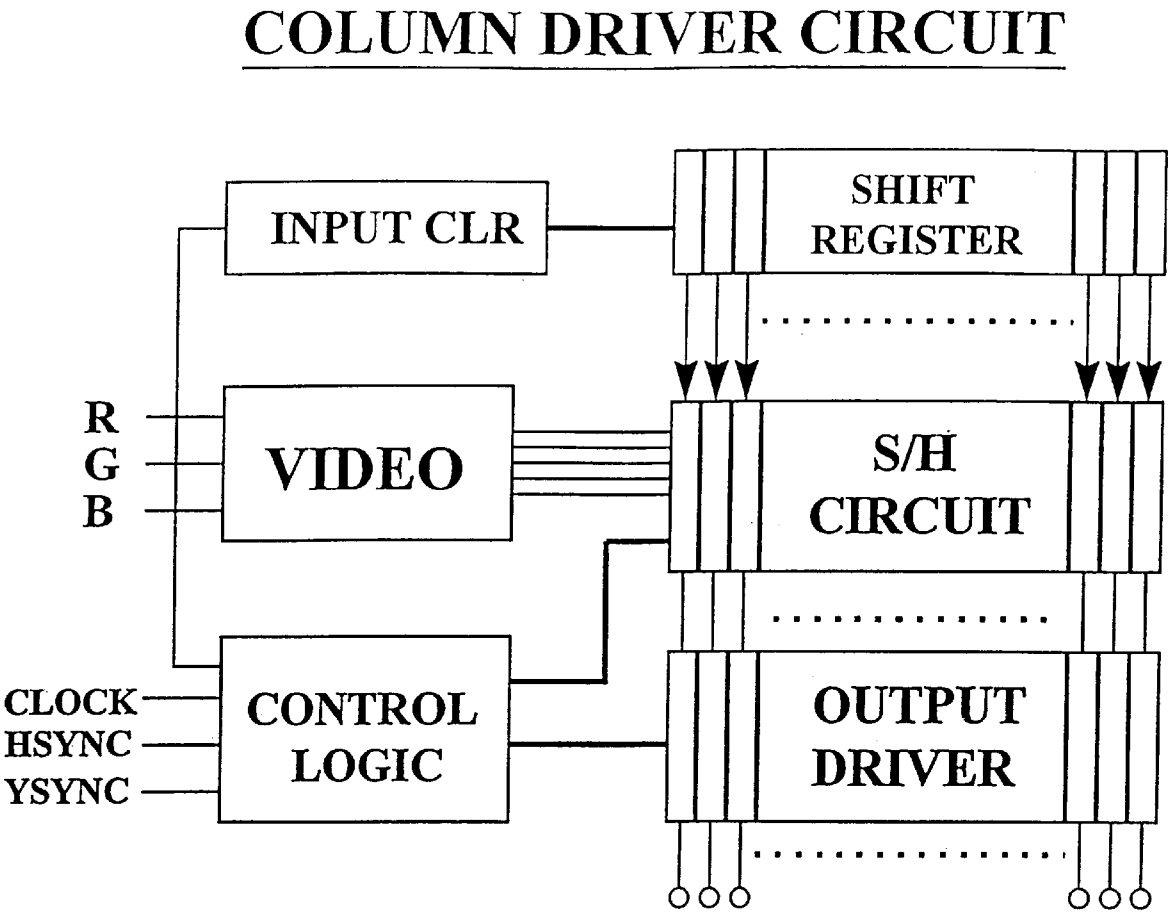
FIG. 2 (PRIOR ART)
FIG. 2 is simplified block diagram of a column driver circuit.

FIG. 2 shows a simple block diagram of an off-glass column driver circuit. In the column driver circuit, the red R, green G and blue B input signals are multiplexed to the S/H circuits in concert with the output signals from shift register. The clock and horizontal/vertical synchronization signals are provided by control logic circuitry. The outputs of the S/H circuits are coupled to the corresponding output driver circuits. There are normally M output drivers and 2M S/H circuits on a column driver circuit in a display system shown in FIG. 1, where two S/H circuits correspond to one output driver.

Figure 3:
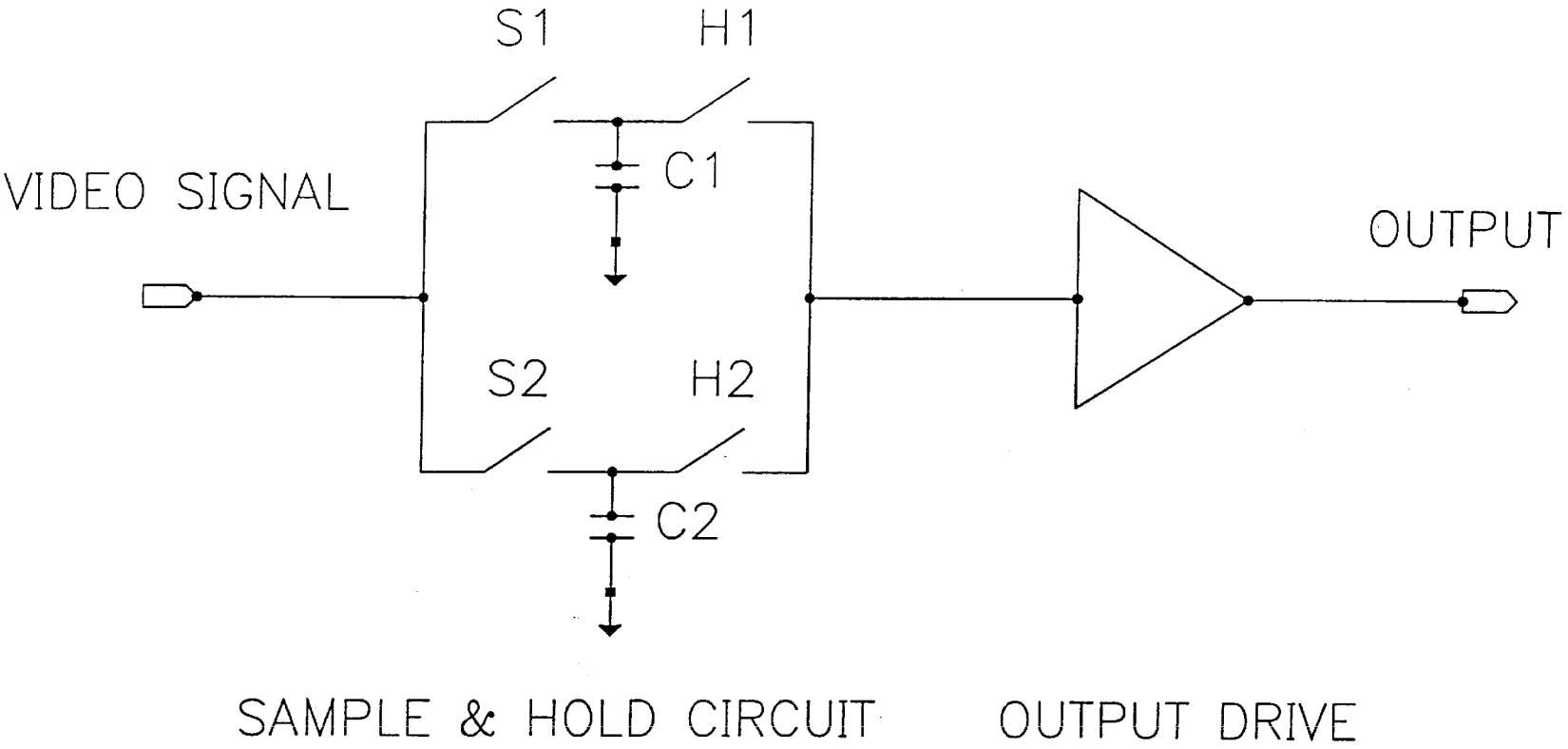
FIG. 3 (PRIOR ART)
FIG. 3 is a simplified schematic diagram of each output stage with two S/H circuits for a column driver circuit.

FIG. 3 shows a simplified schematic of an output stage of the column driver circuit which includes two S/H circuits and an output driver commonly implemented in a system shown in FIG. 1. As is well known in the art, at any given time period during a frame time (about 16.6 mS) except blanking period, a line is scanned, and a row lines 1 to Z are sequentially scanned within a frame time. Thus, the outputs of a column driver circuit are coupled to the display inputs during a line time while sampling is also effected at the same time.

Figure 4:
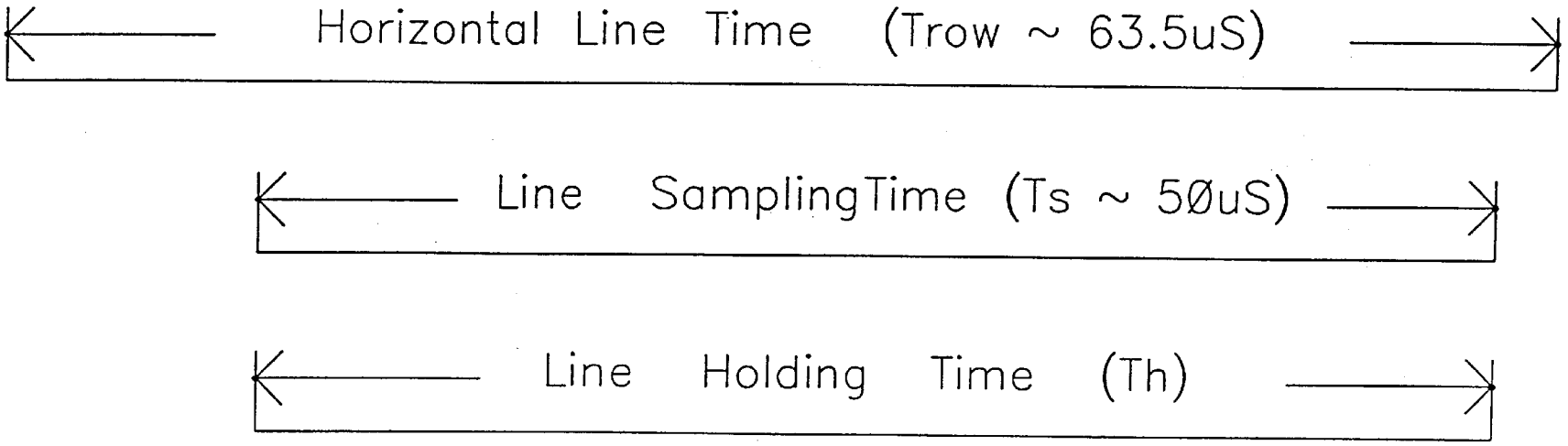
FIG. 4 (PRIOR ART)
FIG. 4 is a driving scheme for S/H circuits in accordance with the prior art.

The operation can be explained more clearly by referring to FIG. 3 and FIG. 4. During a line time while sampling and outputting are in effect, switch S1 for different columns is sequentially closed from output 1 to output N×M for sampling the input data for the next line information during Ts, and all H2 switches for different columns are closed for writing the data to the current scanning line during Th, while S2 and H1 switches are open. Similarly, in the next line time, switch S2 for different columns is sequentially closed from output I to output N×M for sampling the input data for the next line information during Ts, and all H1 switches for different columns are closed for writing the data to the current scanning line during Th, while S1 and H2 switches are open. If S1 and H2 are closed at the same time, the upper S/H circuit comprising S1, H1 and C1 is sampled and the lower S/H circuit comprising S2, H2 and C2 is held for outputting. Likewise, if S2 and H1 are closed at the same time, the lower S/H circuit is sampled and the upper S/H circuit is held for outputting. S1 and H1 (likewise S2 and H2) are not allowed to be closed at the same time during the normal scanning operation. Also, the period of Th can be different from Ts as long as it is within a horizontal line time and stopped before the beginning operation of the sampling for the next line. In the operation for the display system in accordance with the prior art, each S/H circuit is only sampled once and held once in a line time as shown in FIG. 4. Note that a minimum of two S/H circuits are needed for each output stage of a column driver circuit shown in FIG. 1.

Figure 5:
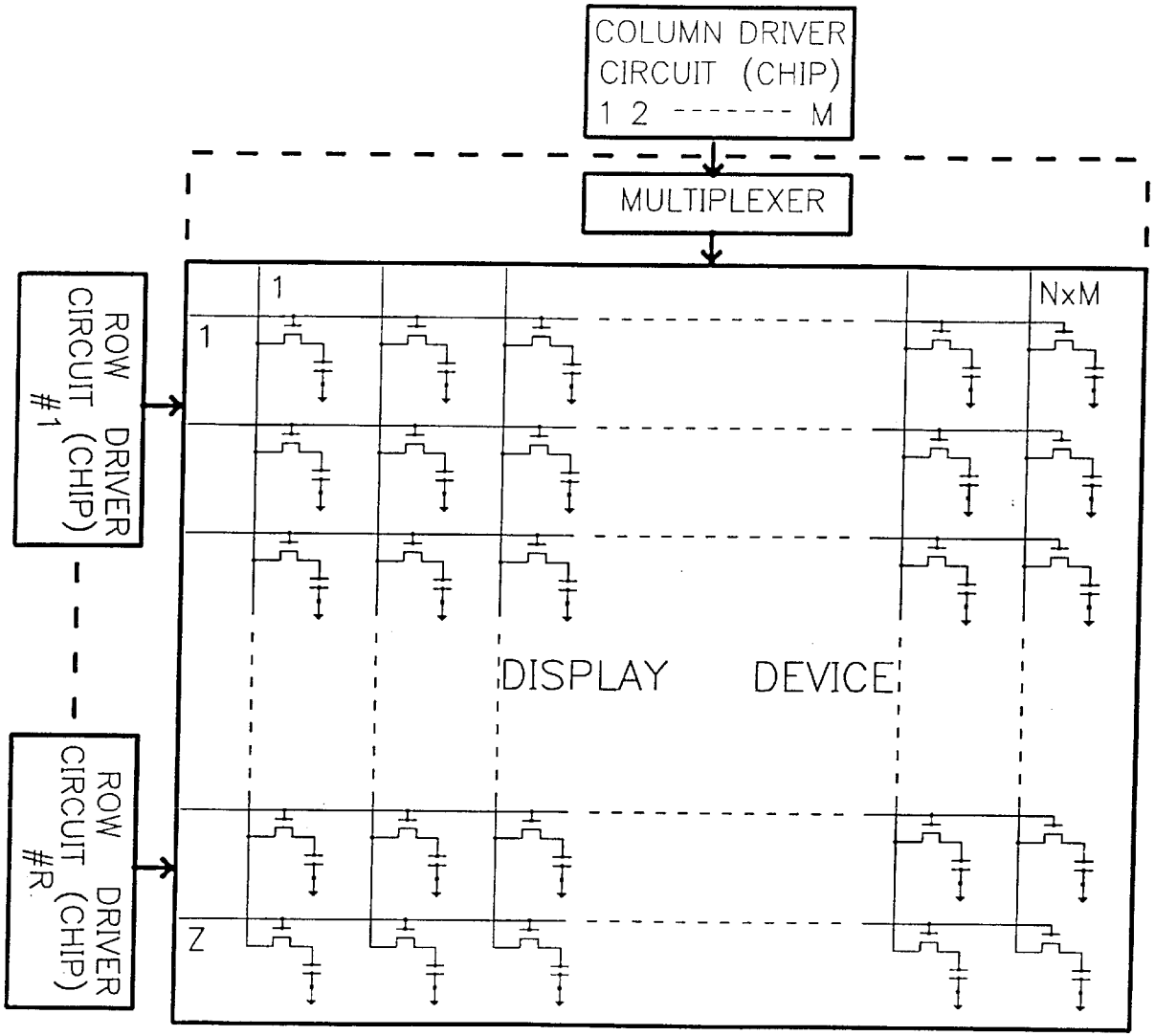
FIG. 5 is a simplified block diagram of a display system with the column inputs coupled to the display device in a multiplexed scheme.
Figure 6:
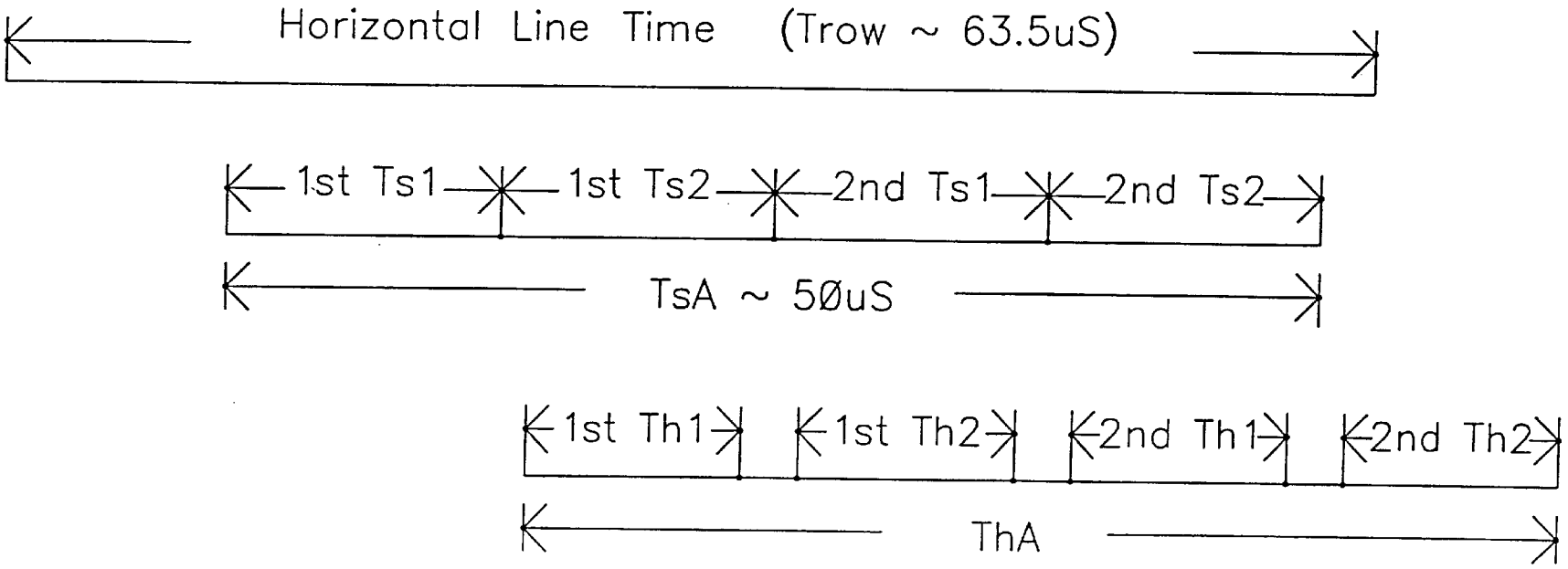
FIG. 6 is a novel driving scheme for S/H circuits in accordance with the present invention.

In this invention, a different multiplexing driving timing scheme is used for a display column inputs as shown in FIG. 5. The output stage of the column driver circuit with two S/H circuits shown in FIG. 3 can still be used, but the driving timing scheme of FIG. 4 cannot be applied. Instead, a new driving timing scheme for S/H circuits shown in FIG. 6 is applied. Again, referring to FIG. 3, the operation of the switches S1, S2, H1 and H2 are similar to the operation as described in the foregoing paragraph, except that the same column driver, or more specifically a set of M output stages, is used for sampling and holding (outputting) N times in a line time by using a driving scheme of FIG. 6 where N=4.

Referring to FIG. 6, S1 for different columns is sequentially closed so that C1 for the respective columns is sequentially sampled from stage 1 to stage M, where M=120 for the example, during each of the 1st and 2nd Ts1 time periods. In this figure, ThA is the period between the beginning of 1st Th1 and the end of 2nd Th. Similarly, S2 for different columns is sequentially closed so that C2 is sequentially sampled accordingly from stage 1 to stage M, during each of the 1st and 2nd Ts2 time periods. The input data information sampled during the 1st Ts1 time period is held for outputting during the 1st Th1 time period, the input data information sampled during the 1st Ts2 time period is held for outputting during the 1st Th2 time period. In the next instant, the input data information sampled during the 2nd Ts1 time period is held for outputting during the 2nd Th1 time period. Similarly, the input data information sampled during the 2nd Ts2 time period is held for outputting during the 2nd Th2 time period. Again, time periods Ts1 and Th1 are not allowed to be overlapped, and Ts2 and Th2 are not allowed to be overlapped. Thus, in this example, where N=4 and M=120, all 120 output stages are sampled and outputted four times in a line time. This cannot be accomplished with the S/H driving scheme shown in FIG. 4 which is the prior art, because in an unscanned AMLCD one of two S/H circuits samples the input video signal for the entire next horizontal line only once and the other S/H circuit holds the information of the current horizontal line for outputting only once during one horizontal scanning fine time. In addition, the sampling and outputting of the same line data information can be accomplished in a given line time in this invention (Note in FIG. 6 that the 2nd Th2 for the current line data can be allocated before 1st Ts2 in the following line time, since in this way Th2 is not overlapped with Ts2 as required). In the display system in accordance with the prior art, however, the current line information is outputted and the next line information is sampled in a given line time.

Figure 7:
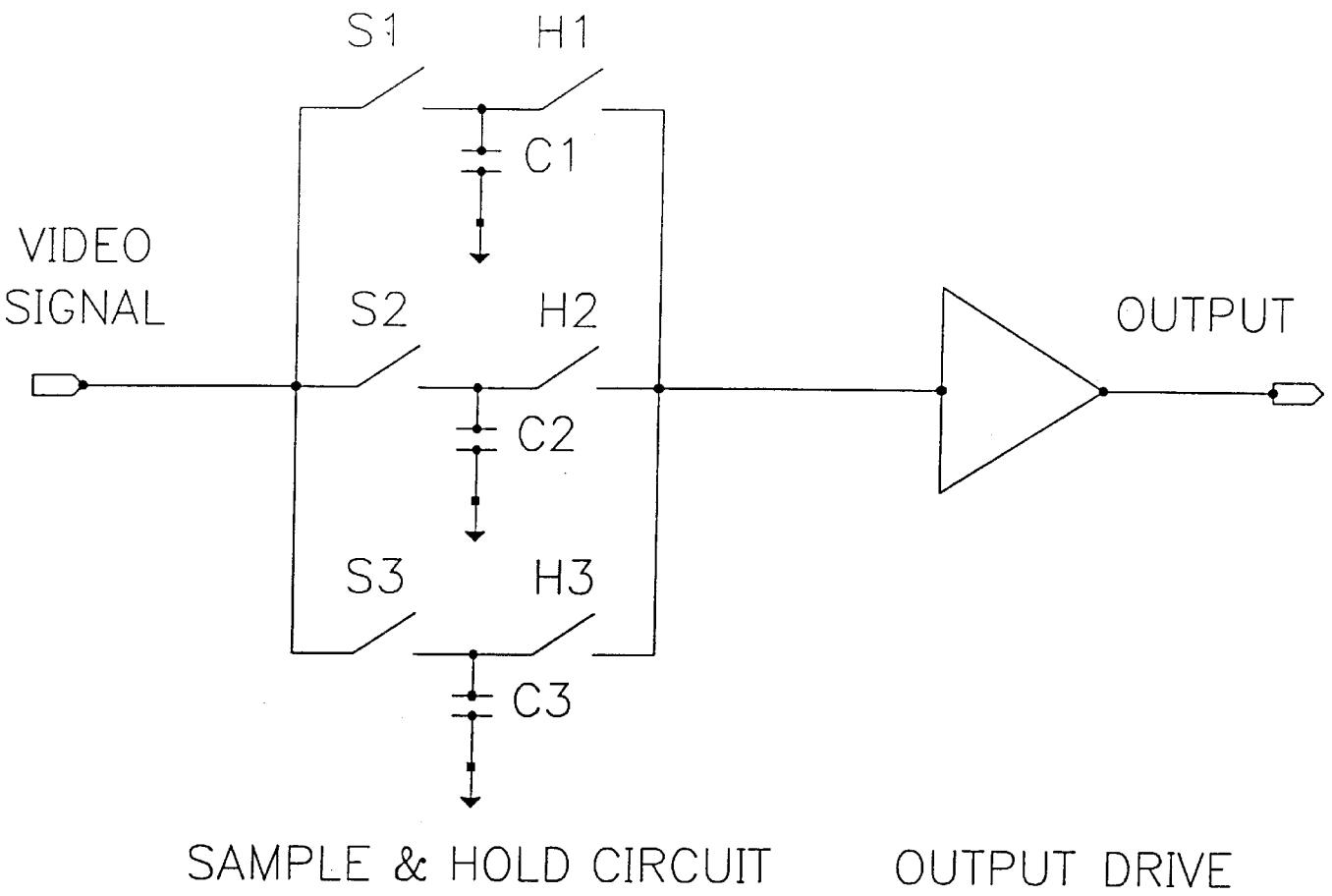
FIG. 7 is a simplified schematic diagram of each output stage with three S/H circuits for a column driver circuit in accordance with the present invention.

Although the number of S/H circuits is two as shown in FIG. 3 in this example, the number of S/H circuits for each output stage of the column driver circuit is not limited to two. It can also be any number greater than two depending on the design. For example, if N outputting operations are needed to be completed in a certain portion of a line time period, which can be greater than, equal to or considerably less than the sampling time, three S/H circuits in each output stage may be required as shown in FIG. 7. In FIG. 6, the period of 1st Th1 has to be within the period of 1st Ts2, since Th1 and Ts1 cannot be overlapped. Similarly, the period of 1 st Th2 must be within 2nd Ts1, and the period of 2nd Th2 is usually the same as 1st Th2 period (or Th1). In the same manner, the period of 2nd Th1 must be within the period of 2nd Ts2, since Th2 and Ts2 cannot be overlapped. Therefore, Th1 and Th2 time locations are quite constrained and the period length of ThA is very close to the period length of TsA as shown in FIG. 6. In fact, the period of 1st Th1 does not have to be within the period of 1st Ts2 as long as 1st Th1 lags behind 1st Ts1 in a given length of a line period, and Ts1 and Th1 are not overlapping. The same scenarios can be applied to other Th's, if three or more S/H capacitors in an output stage are used. In some applications, more time is required for outputting during each segment of holding time period than each segment of sampling time if there are constraints such as drive-ability in the multiplexer circuit and/or switching circuits of the display device. This is shown as an example only in FIG. 8, where ThB (same as ThC in FIG. 9) is the period between the beginning of 1st Th1 and the end of 2nd Th1, and the length of ThB is greater than (or equal to) TsB as can be seen that T2>T1. In still some other applications, the time location and period length of all holding times are constrained in a certain time period, which can be much less than the sampling period Ts, so that the time saved can be utilized for other purposes allocated for multiplexer circuit and/or switching circuits of the display device. This is shown as an example only in FIG. 9, where the length of ThC is much less than TsB. As it can be seen from FIG. 8 and FIG. 9, the flexibility of holding time periods in terms of time location and period length can be achieved by using three branches of S/H circuits. Note in FIGS. 8 and 9 that the 2nd Th1 for the rent line data can be allocated before 1st Ts1 in the following line time, since in this way Th1 is not overlapped with Ts1 as required.

Figure 8:
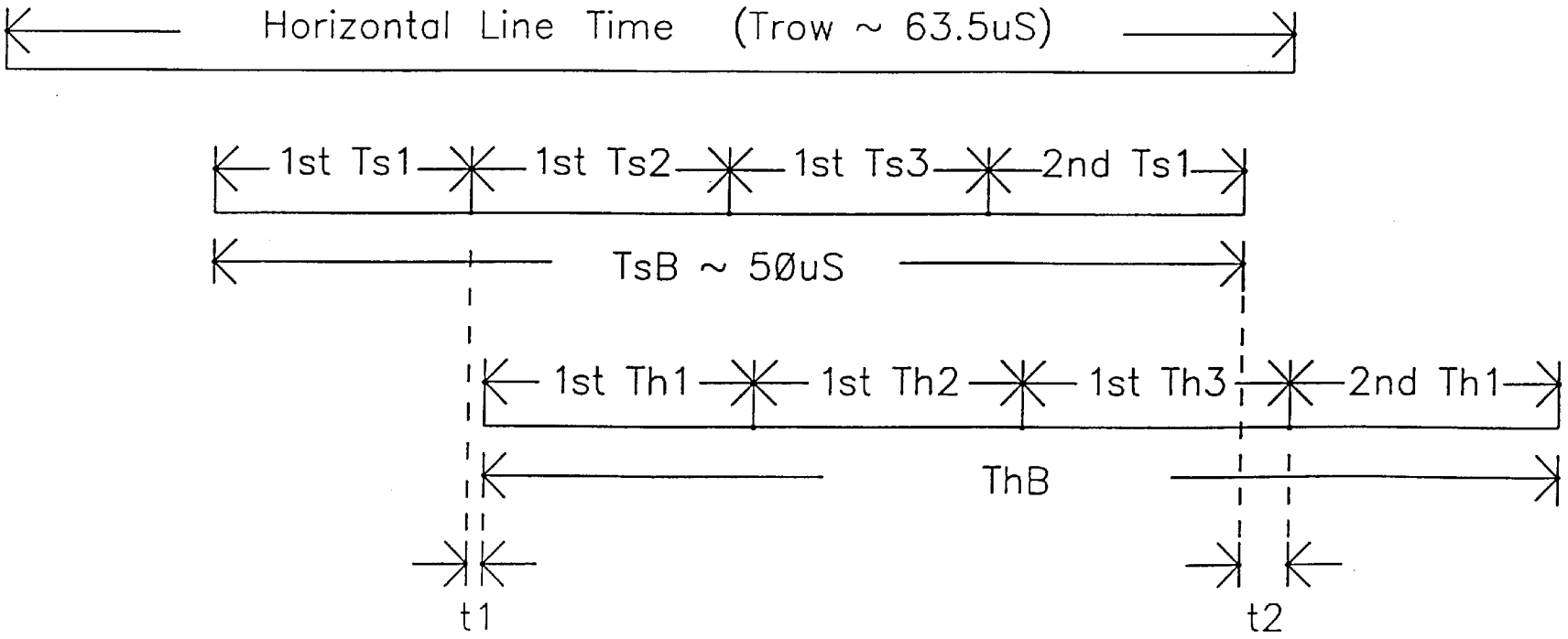
FIG. 8 is a driving scheme for S/H circuits with three branches in accordance with the present invention.
Figure 9:
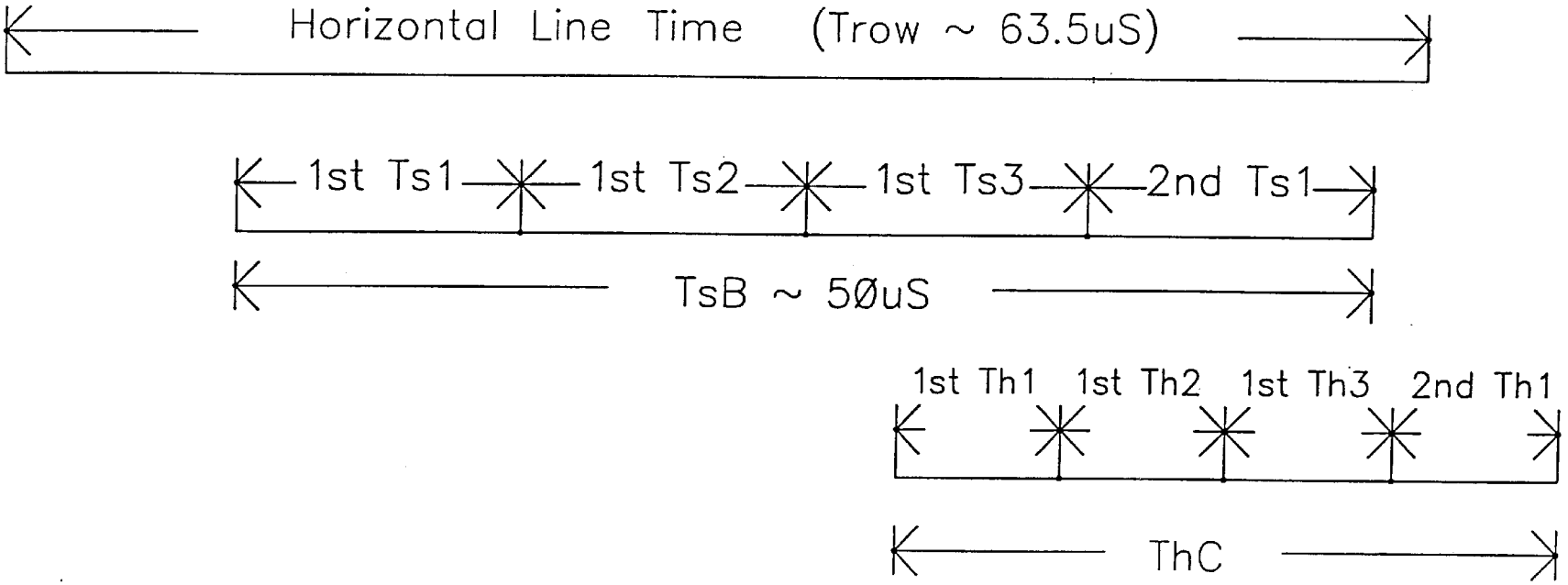
FIG. 9 is another driving scheme for S/H circuits with three branches.

It should be noted that the driving schemes in FIGS. 6 and 8 are only examples for N=4. Actually N can also be either less or greater than 4 as required and permitted by design. For example, if N=6 and the 2-S/H circuit structure are used, a horizontal sampling time can be segmented to 6, and each branch of two S/H circuits is used three times for sampling and three times for holding (for outputting) in a horizontal line time. Similarly, if N=6 and 3-S/H circuit structure are used, a horizontal sampling time can be segmented to 6 and each branch of three S/H circuits is used twice for sampling and twice for holding (or outputting) in a horizontal line time. Also, more than three branches of S/H circuits may be used.

Although a video display system is used as an example, it is not limited to the video system in this invention. While the invention has been described in connection with a preferred embodiment, it is not intended to limit the scope of the invention to the particular form set forth. On the contrary, it is intended to cover such alternatives, modifications and equivalents as may be included within the spirit and scope of the invention.

What is claimed is:

1. A driving scheme for an active matrix display device wherein a multiplicity of picture elements (pixels) are fed with video signal data through N×M number of columns, where N is the number of groups which a horizontal scanning line is subdivided and M is number of columns in each said group, comprising:

a column driver for each said group, having M number of sample and hold circuits, each one of said sample and hold circuits having at least two branches, each comprising a sampling switch and storage capacitor and a holding switch connected to one of said columns, said sampling switch and said holding switch for each branch being timed to close without overlapping and to close more than once during a horizontal line scanning time; and a multiplexer driven by said driver and driving M number of said columns.

2. A driving scheme for an active matrix display device as described in claim 1, wherein the number of said column driver is equal to one.

3. A driving scheme for an active matrix display device as described in claim 1, wherein said column driver is an integrated circuit.

4. A driving scheme for an active matrix display device as described in claim 1, wherein the number of said branches is two with a first branch and a second branch.

5. A driving scheme for an active matrix display device as described in claim 4, wherein said sampling switch of each branch is turned on twice during said a horizontal line scanning time.

6. A driving scheme for an active matrix display device as described in claim 4, wherein the sampling switch of said first branch and the sampling switch of said second branch are alternately turned on, as are the holding switch of said first branch and the holding switch of said second branch.

7. A driving scheme for an active matrix display device as described in claim 1, wherein the number of said branches is three with a first branch, a second branch and a third branch.

8. A driving scheme for an active matrix display device as described in claim 7, wherein said sampling switch of each branch is turned on twice during said a horizontal line scanning time.

9. A driving scheme for an active matrix display device as described in claim 7, wherein said sampling switch of said first branch, the sampling switch of said second branch and the sampling switch of said third branch are sequentially turned on, as are the holding switch of said first branch, the holding switch of said second branch, and the holding switch of said third branch.

10. A driving scheme for an active matrix display device as described in claim 7, wherein the time for turning on sequentially all three of said sampling switch is less than one said scanning line time.

11. A driving scheme for an active matrix display device as described in claim 7, wherein the time for turning on said holding switch is longer than the time for turning on said sampling switch.

12. A driving scheme for an active matrix display device as described in claim 7, wherein the time for turning on said holding switch is shorter than the time for turning on said sampling switch.

13. A driving scheme for an active matrix display device as described in claim 7, wherein the time for turning on said holding switch is equal to the time for turning on said sampling switch.

14. A driving scheme for an active matrix display device as described in claim 1, where a total sampling time for closing the sampling switch in all said branches for one scanned line is less than the scanning time of a horizontal line.

15. A driving scheme for an active matrix display device as described in claim 14, wherein a total holding time for closing the holding switch in all said branches for one scanned line is less than said total sampling time.

16. A driving scheme for an active matrix display device as described in claim 14, wherein a total holding time for closing the holding switch in all said branches for one scanned line is equal to said total sampling time.

17. A driving scheme for an active matrix display device as described in claim 14, wherein a total holding time for closing the holding switch in all said branches for one scanned line is greater than said total sampling time.

* * * * *